US011446726B2

(12) United States Patent
Sprotberry et al.

(10) Patent No.: US 11,446,726 B2
(45) Date of Patent: Sep. 20, 2022

(54) METAL FASTENING DIE ASSEMBLY

(71) Applicant: BTM Company, LLC, Marysville, MI (US)

(72) Inventors: Steven J. Sprotberry, Marysville, MI (US); Hans-Werner Fisch, Erwitte (DE)

(73) Assignee: BTM Company, LLC, Marysville, MI (US)

( * ) Notice: Subject to any disclaimer, the term of this patent is extended or adjusted under 35 U.S.C. 154(b) by 0 days.

(21) Appl. No.: 15/931,921

(22) Filed: May 14, 2020

(65) Prior Publication Data

US 2021/0354188 A1 Nov. 18, 2021

(51) Int. Cl.

| | |
|---|---|
| ***B21D 39/03*** | (2006.01) |
| ***B21D 28/34*** | (2006.01) |
| ***B21D 37/04*** | (2006.01) |
| ***B21D 37/10*** | (2006.01) |
| *B21D 45/00* | (2006.01) |
| *B21J 15/02* | (2006.01) |

(52) U.S. Cl.

CPC ..... *B21D 39/031* (2013.01); *B21D 28/34* (2013.01); *B21D 37/04* (2013.01); *B21D 37/10* (2013.01); *B21D 39/034* (2013.01); *B21D 39/035* (2013.01); *B21D 45/006* (2013.01); *B21J 15/025* (2013.01); *Y10T 29/49833* (2015.01); *Y10T 29/49835* (2015.01); *Y10T 29/49837* (2015.01)

(58) Field of Classification Search

CPC .. B21D 39/031; B21D 39/034; B21D 39/035; B21D 37/10; B21D 37/04; B21D 28/34; Y10T 29/49837; Y10T 29/49835; Y10T 29/49833

USPC ..... 29/798, 283.5, 21.1; 72/481.3, 395

See application file for complete search history.

(56) References Cited

U.S. PATENT DOCUMENTS

| | | | |
|---|---|---|---|
| 4,459,735 | A | 7/1984 | Sawdon |
| 4,574,453 | A | 3/1986 | Sawdon |
| 4,574,473 | A | 3/1986 | Sawdon |
| 4,722,647 | A | 2/1988 | Sawdon |
| 4,757,609 | A | 7/1988 | Sawdon |

(Continued)

FOREIGN PATENT DOCUMENTS

| | | |
|---|---|---|
| DE | 69320969 | 9/1999 |

OTHER PUBLICATIONS

Photos of Eckold Die (offered for sale prior to Apr. 2020).

(Continued)

*Primary Examiner* — Jermie E Cozart

(74) *Attorney, Agent, or Firm* — Harness, Dickey & Pierce PLC

(57) ABSTRACT

A metal fastening or joining apparatus is provided. In another aspect, a single piece die guard includes an integral die shield section and an integral retainer section, wherein a die anvil can be removed, and the die shield section has a low height and a small lateral square width. A further aspect employs a generally square peripheral shape for a die shield within which is an anvil and movable die blades, which are operable to fasten or join sheet metal workpieces together in an interlocking manner. In still another aspect, a projecting and/or peripheral orientation structure is on a backside of a workpiece fastening die assembly which allows for anvil reorientation without the need to also reorient a laterally surrounding die shield and retainer.

35 Claims, 10 Drawing Sheets

(56) References Cited

U.S. PATENT DOCUMENTS

| | | | | |
|---|---|---|---|---|
| 4,878,284 | A | 11/1989 | Sawdon | |
| 4,910,853 | A | 3/1990 | Sawdon | |
| 4,972,565 | A * | 11/1990 | Eckold | B21D 39/031 29/243.529 |
| 5,027,503 | A | 7/1991 | Sawdon | |
| 5,150,513 | A | 9/1992 | Sawdon | |
| 5,177,861 | A | 1/1993 | Sawdon | |
| 5,208,973 | A | 5/1993 | Sawdon | |
| 5,208,974 | A | 5/1993 | Sawdon et al. | |
| 5,267,383 | A | 12/1993 | Sawdon | |
| 5,339,509 | A | 8/1994 | Sawdon et al. | |
| 5,431,089 | A | 7/1995 | Sawdon | |
| 5,435,049 | A | 7/1995 | Sawdon | |
| 5,479,687 | A | 1/1996 | Sawdon | |
| 5,581,860 | A | 12/1996 | Sawdon | |
| 5,709,019 | A | 1/1998 | Sawdon | |
| 5,727,302 | A | 3/1998 | Sawdon | |
| 5,737,819 | A | 4/1998 | Sawdon et al. | |
| 5,782,130 | A | 7/1998 | Sawdon | |
| 5,860,315 | A | 1/1999 | Sawdon | |
| 5,992,206 | A * | 11/1999 | Kuhne | B21D 28/34 29/21.1 |
| 6,092,270 | A | 7/2000 | Sawdon | |
| 6,430,794 | B1 * | 8/2002 | McKee | B21D 39/031 29/243.5 |
| 6,430,795 | B1 | 8/2002 | Sawdon et al. | |
| 6,612,007 | B1 | 9/2003 | Wade | |
| 6,757,951 | B2 | 7/2004 | Sawdon et al. | |
| 6,785,959 | B2 | 9/2004 | Sawdon et al. | |
| 7,003,861 | B2 | 2/2006 | Sawdon et al. | |
| 7,694,399 | B2 | 4/2010 | Sawdon et al. | |
| 8,650,730 | B2 | 2/2014 | Sawdon | |
| 8,881,364 | B2 | 11/2014 | Sawdon et al. | |
| 9,421,599 | B2 | 8/2016 | Sawdon et al. | |
| 9,931,720 | B2 | 4/2018 | Sawdon et al. | |
| 10,328,481 | B2 | 6/2019 | Koenigbauer et al. | |
| 2007/0266759 | A1 | 11/2007 | Kuehne | |
| 2010/0212131 | A1 * | 8/2010 | Sawdon | B21D 39/031 29/243.5 |

OTHER PUBLICATIONS

Drawing of BTM TL-3.8 940-LP Die Assembly (offered for sale prior to Apr. 2020).

Introduction to Tog-L-Loc®: An overview of BTM's Tog-L-Loc® sheet metal clinching system, URL: http://www.btmcomp.com/images/catalogs/btm-brochure-introduction-to-tog-l-loc.pdf, Brochure ID # 733864CB, 24 pages, published prior to Apr. 2020.

Tog-L-Loc® Tooling: 940 Series: Standard Dies, Punches, Strippers, & Holders for Clinching Sheet Metal, URL: http://www.btmcomp.com/images/catalogs/btm-catalog-940-tog-l-loc-tooling.pdf, Catalog ID# 732965RA, 32 pages, published prior to Apr. 2020.

Tog-L-Loc® Clinch Tooling: Standard, Semi-Standard and Special Tog-L-Loc Solutions, URL: http://www.btmcomp.com/images/catalogs/btm-catalog-tog-l-loc-tooling-[non-940].pdf, Catalog ID # 733201FA, 36 pages, published prior to Apr. 2020.

Lance-N-Loc® Clinch Tooling: Standard Punches, Dies, Strippers, & Holders for clinching sheet metal, URL: http://www.btmcomp.com/images/catalogs/btm-catalog-lance-n-loc-tooling.pdf, Catalog ID # 733440BC, 16 pages, published prior to Apr. 2020.

V-Loc™ 940 Series Clinch Tooling Catalog: The Standard for Clinching Aluminum, URL:http://www.btmcomp.com/images/catalogs/btm-catalog-940-v-loc-tooling.pdf, Catalog ID # 735425BB, 20 pages, published prior to Apr. 2020.

Oval-Loc® Clinch Tooling Catalog: Combining rotation resistance with leak-proof characteristics, URL: http://www.btmcomp.com/images/catalogs/btm-catalog-oval-loc-tooling.pdf, Catalog ID# 735501AB, 16 pages, published prior to Apr. 2020.

* cited by examiner

METAL FASTENING DIE ASSEMBLY

BACKGROUND AND SUMMARY

The present disclosure generally pertains to a fastening apparatus and more particularly to a metal fastening die assembly.

It is well known to employ a punch and die assembly to create a clinch joint within sheet metal workpieces located therebetween. Furthermore, many conventional die assemblies are mounted onto separate die retainers or holders in order to secure the die assemblies to a frame of an actuator tool. Examples of such die assemblies and separate holders are disclosed in the following U.S. patents invented by Sawdon which are commonly owned with the present application: U.S. Pat. No. 7,694,399 entitled "Sheet Fastening Apparatus and Method" which issued on Apr. 13, 2010; U.S. Pat. No. 6,430,795 entitled "Composite Urethane Stripper for Metal Joining Apparatus" which issued on Aug. 13, 2002; and U.S. Pat. No. 5,860,315 entitled "Device for Securing Tools" which issued on Jan. 19, 1999. These patents are all incorporated by reference herein. While these devices were significant improvements in the industry, the separate external shield of the die assembly in addition to the distinct holder sometimes causes extraneously redundant components and also can add undesired extra height to the combination which may render fastening access difficult when certain workpiece shapes are encountered.

FIGS. 12-14 of commonly owned U.S. Pat. No. 5,479,687 entitled "Apparatus for Joining Sheets of Material" which issued to Sawdon on Jan. 2, 1996, shows a die retainer integral with an outer sleeve. However, the anvil cannot be removed for replacement due to wear during use. This patent is also incorporated by reference herein.

Commonly owned U.S. Pat. No. 8,650,730 entitled "Clinching Tool" which issued to Sawdon on Feb. 18, 2014, discloses a die body with a generally rectangular exterior periphery. A pair of laterally elongated die members laterally traverse toward and away from a central anvil, and there is no ability to reorient the movable die members relative to the die body. While this patent is a significant improvement in the industry, a smaller lateral packaging size would be desirable for certain workpiece uses. This patent is incorporated by reference herein.

In accordance with the present invention, a metal fastening or joining apparatus is provided. In another aspect, a single piece die guard includes an integral die shield section and an integral retainer section, wherein a die anvil can be removed, and the die shield section has a low height and a small lateral square width. A further aspect employs a generally square peripheral shape for a die shield within which is an anvil and movable die blades, which are operable to fasten or join sheet metal workpieces together in an interlocking manner. In still another aspect, a projecting and/or peripheral orientation structure is on a backside of a workpiece fastening die assembly which allows for anvil reorientation without the need to also reorient a laterally surrounding die shield and retainer. In an additional aspect, a single piece die guard includes an integral die shield section and an integral retainer section with the retainer section stepped down from and laterally extending from only one side of the die shield section, wherein a die anvil can be removed. A method of assembling a die assembly is additionally provided.

The present apparatus and method are advantageous over traditional devices. For example, the integral shield and retainer sections reduce separate parts while providing a low height profile and smaller lateral size, to more easily access workpieces. The specific shape of the present die shield beneficially provides a low height profile and smaller lateral size to more easily fasten difficult to access workpieces. Furthermore, the present design makes assembly and disassembly of the die blades and the anvil much easier. Moreover, fewer parts and multi-functionality are beneficially achieved with the present apparatus. The present assembly and method advantageously make it easier and more accurate to reorient a central anvil and/or surrounding die blades, but without the need to reorient the outer die shield and fixture. The single piece and integral nature of the die shield and retainer improve the strength of the die assembly and its mounting, in certain aspects of the present apparatus. Certain component integration and separation in various embodiments allow for the use of different and more durable materials for some parts while reducing expense for other parts; by way of non-limiting example, the integrated anvil and base may be made of a more durable metal than the less expensive metal of the integral die shield and die retainer. Additional advantages and features of the present apparatus and method can be ascertained from the following description and appended claims, taken in conjunction with the accompanying drawings.

DETAILED DESCRIPTION

Figure 1:
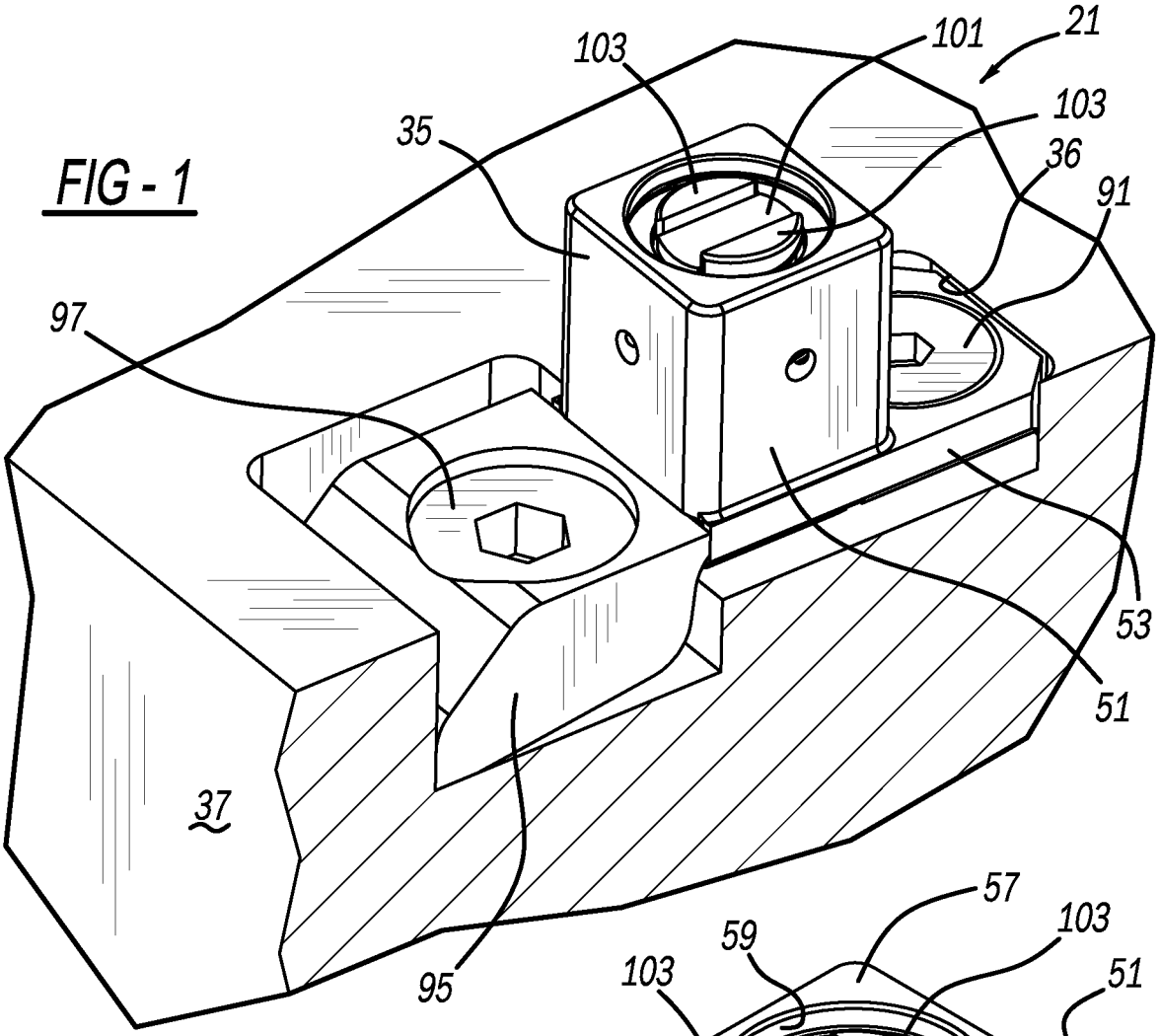
FIG. 1 is a partially fragmentary and top perspective view showing a first embodiment of the present fastening assembly mounted to a machine frame.
Figure 2:
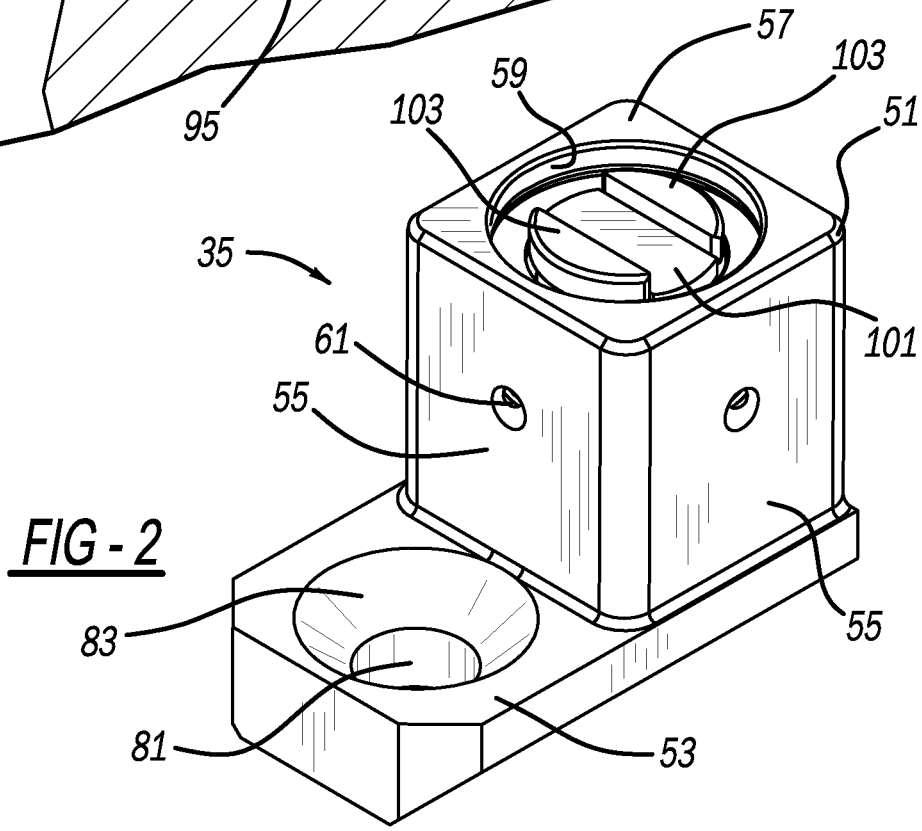
FIG. 2 is a top perspective view showing the first embodiment of the present fastening assembly.

A first exemplary embodiment of a fastening or joining apparatus 21 is illustrated in FIGS. 1-12 and includes a die assembly 35 mounted within a pocket 36 of a metallic C-frame or other machine fixture 37. A pneumatically or hydraulically fluid-powered actuator linearly advances and retracts a longitudinally elongated punch 39 and laterally surrounding spring-biased stripper. Alternately, the punch may be electromagnetically powered such as with an electric motor which drives an associated output transmission spindle. Alternately, the punch may rotatably advance and retract relative to a stationary die, if a scissor linkage is employed for fastening sheet metal air ducts, by way of a non-limiting example. Two or more sheet metal workpieces 41 are joined or fastened together between punch 39 and die assembly 35 as will be discussed in greater detail hereinafter.

Die assembly 35 includes a die guard having a longitudinally elongated die shield 51 and a retainer 53 laterally projecting from a side of the die shield. Die shield or housing 51 has a generally cubic shape defined by four flat, exterior and lateral faces 55 and a substantially square end 57 which contacts one of the workpieces during joining. Rounded or chamfered corners are present at the intersections between faces 55, and where end surface 57 intersects lateral faces 55, to deter tearing of the workpieces when in contact therewith. A longitudinally elongated and cylindrically shaped, internal through bore 59 extends through die shield 51. Furthermore, a single hole 61 is located within a central flat portion of each face 55 to allow dirt, oil and other manufacturing debris to exit from through bore 59.

It is noteworthy that a backside surface 63 of die shield 51 includes a stepped recess 65. Accordingly, a longitudinal height dimension, between the backside surface 63 and opposite end surface 57 at a clamping side 67, is greater than a similarly measured height dimension where die shield meets with retainer 53, due to this recess. An equilateral, three sided polygonal internal surface 69, with rounded corners, defines a U-shape for recess 65. The parallel spaced apart, internal edges of the recess define a close tolerance keying receptacle as will be discussed in greater detail hereinafter.

The die shield and retainer section are integrally machined from the same steel block as an integral, single piece. A longitudinal height H of die shield 51 is preferably 20.0-15.0 mm and more preferably 20.0 mm, while a height h of retainer 53 is preferably 10.0-5.0 mm and more preferably 5.5 mm; thus, the retainer is less than half the height of the die shield. The preferred height differential between H and h of approximately 10-5 mm is short enough to allow the die assembly to reach into small channels even those having a backbend. Nevertheless, height H may alternately be greater than the preferred range for other uses or when a deeper mounting pocket is provided. Perpendicular lateral widths W of die shield 55 are equidistant, preferably 15.0-13.5 mm and more preferably 15.0 mm. The retainer also contains an internally threaded through bore 81 with a frusto-conical or tapered countersink opening 83 on a top surface thereof. A laterally elongated chamfer 85 is machined on opposite portions of the retainer and die shield for fitting within filleted corners of the frame pocket 36. A central portion of backside 63 of retainer 53 is flat as is the opposite top side surface. The die shield and the retainer define a side view L-shape.

A threaded screw 91, with a wrench receptacle, enmeshes with bore 81 of retainer 53 and an aligned threaded hole 93 in frame 37. Furthermore, a clamp 95 compresses against side 55 of the die shield and an associated cap screw 97 secures the clamp to a threaded hole 99 in frame 37. Thus, fasteners 91, 95 and 97 removably hold die assembly 35 within pocket 36 of the machine frame.

The die components will now be described in greater detail. Die assembly 35 includes an anvil 101 bordered by two movable die blades 103 on opposite sides thereof. Workpiece-contacting distal ends 105 (see FIG. 8) of die blades 103 longitudinally project past a workpiece-contacting surface 107 of anvil 101 and each distal end has a generally partially circular end view shape adjacent flat lateral side sections 109 of the anvil. Distal ends 105 of die blades 103 are circumferentially spaced apart from each other and proximal ends 111 of the die blades are circumferentially curved so as to contact each other surrounding a cylindrical intermediate neck 113 of anvil 101.

Figure 13:
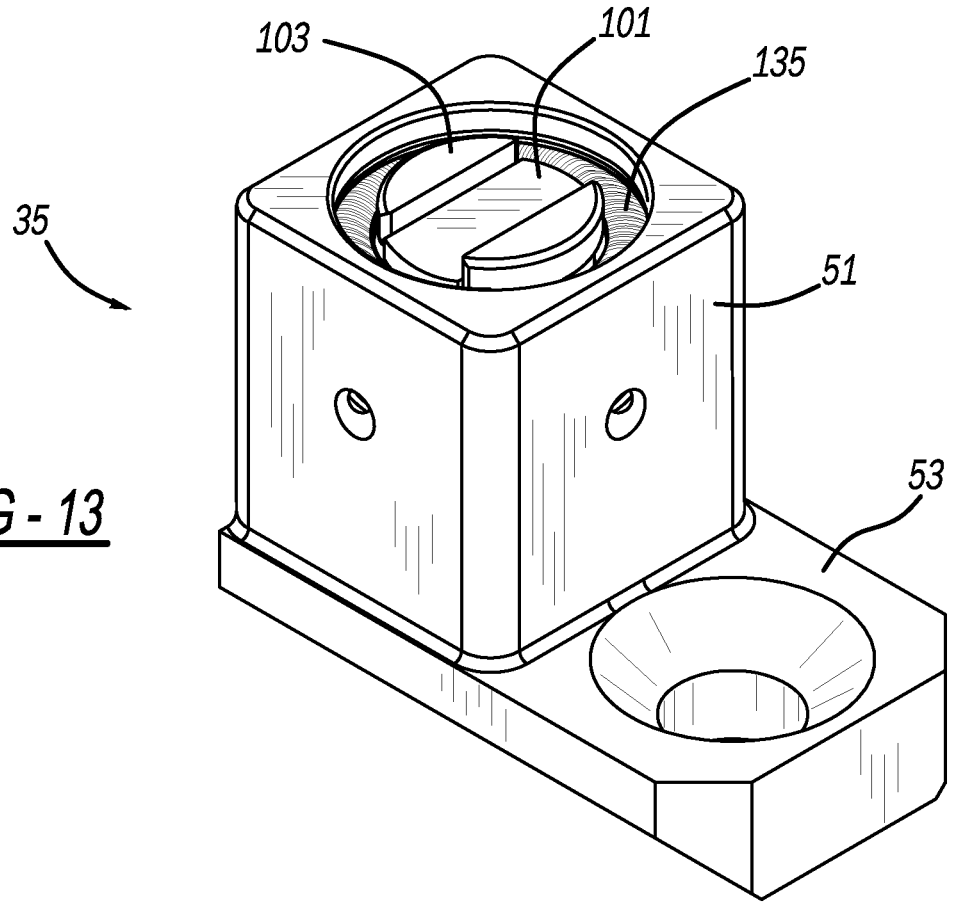
FIG. 13 is a top perspective view showing the first embodiment of the present fastening assembly, with an alternate biasing configuration.

An elastomeric and flexible biasing ring 131 laterally surrounds die blades 103 and urges them toward anvil 101. Ring 131 preferably has a generally inverted U-cross-sectional shape with an open groove in a lower surface thereof to allow its bifurcated annular walls to compress together when a joint 133 is formed between workpieces 41. An alternate biasing member is shown as a canted coiled spring 135 in FIG. 13.

An intermediate, cylindrical die body 141 intersects neck 113 at a laterally enlarged shoulder upon which rests and rotates a bottom of proximal ends 113 of die blades 103. Furthermore, a laterally enlarged base 143 is located at a bottom of the die body section of anvil 101. Anvil 101, neck 113, die body 141 and base 143 are all coaxially aligned with each other about a longitudinal centerline 145 and are a single integral piece made of steel.

Figure 6:
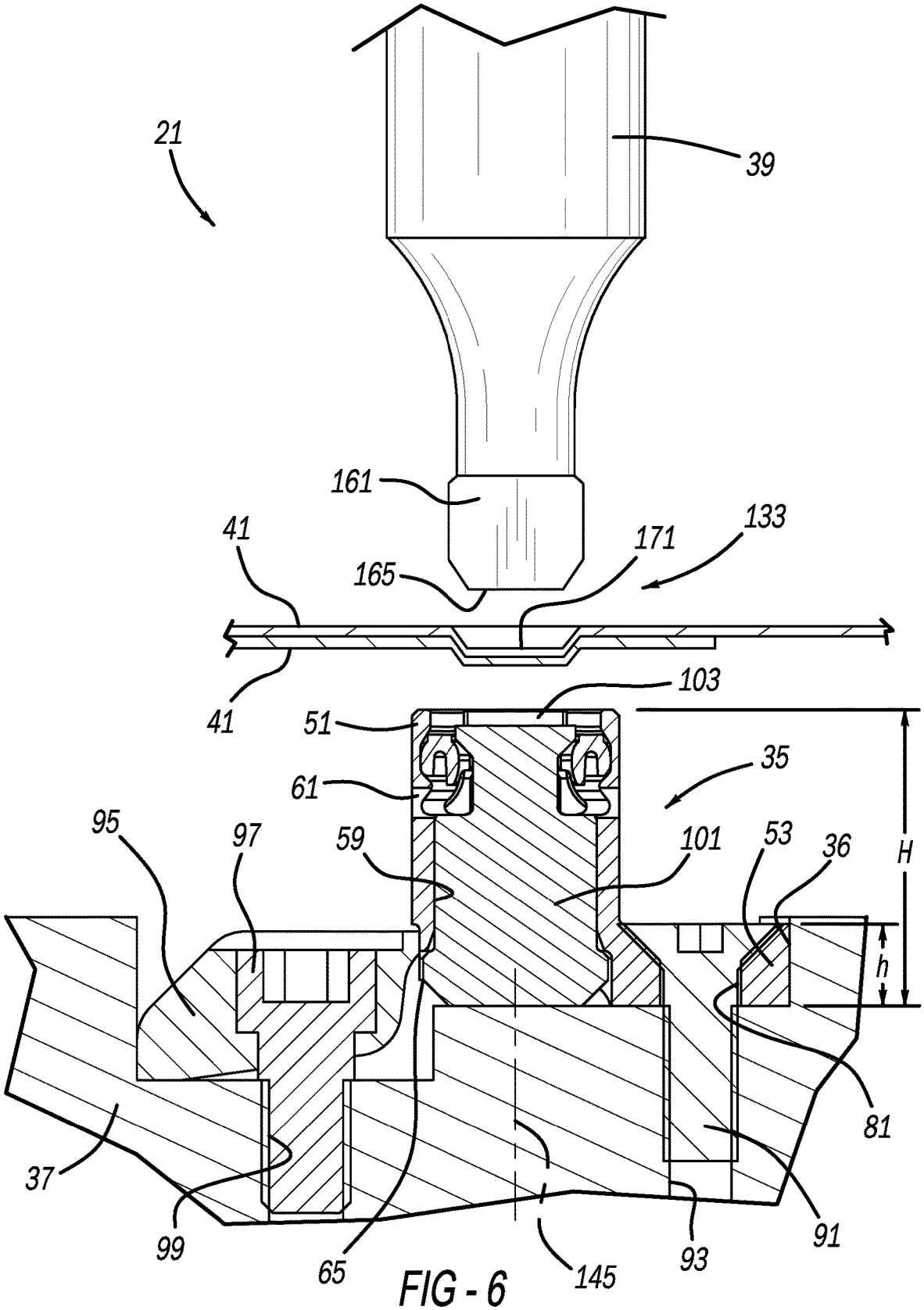
FIG. 6 is a cross-sectional view, taken along line 6-6 of FIG. 4, showing the first embodiment of the present fastening assembly mounted to the machine frame.
Figure 7:
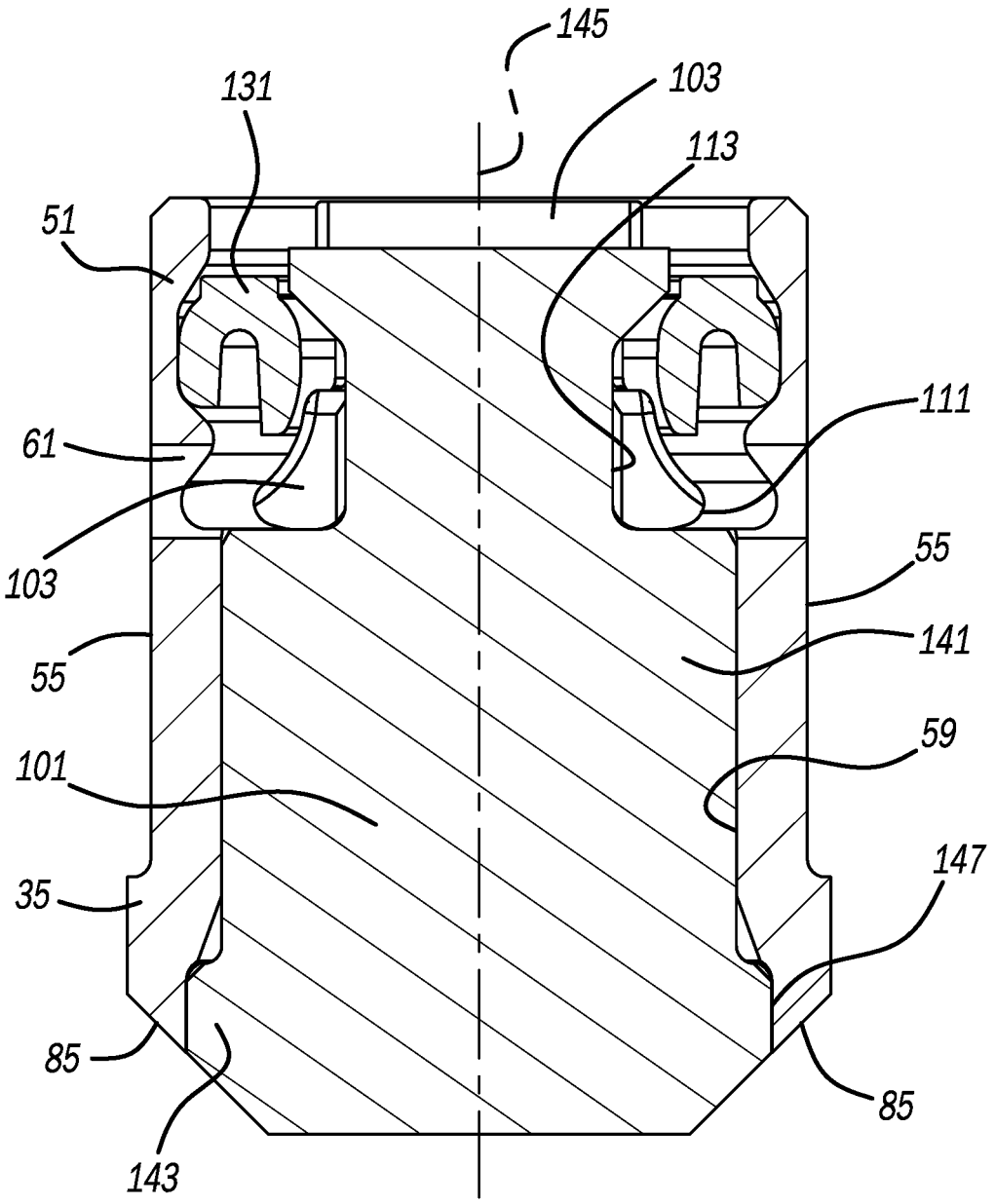
FIG. 7 is a cross-sectional view, taken along line 7-7 of FIG. 4, showing the first embodiment of the present fastening assembly.
Figure 8:
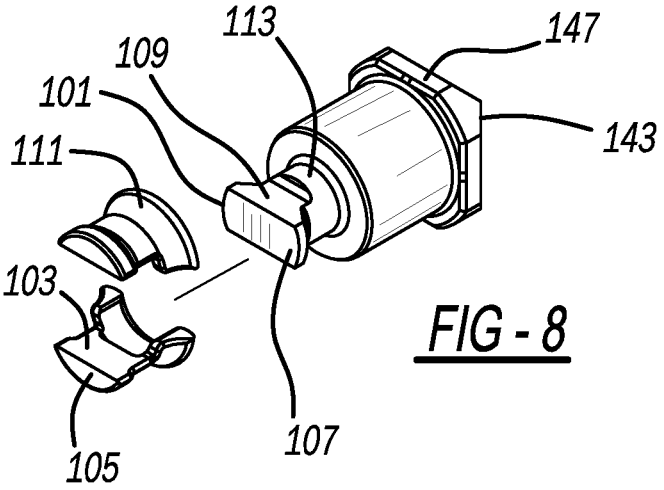
FIGS. 8-12 are a series of partially exploded perspective views showing the first embodiment of the present fastening assembly, in different assembly conditions.
Figure 9:
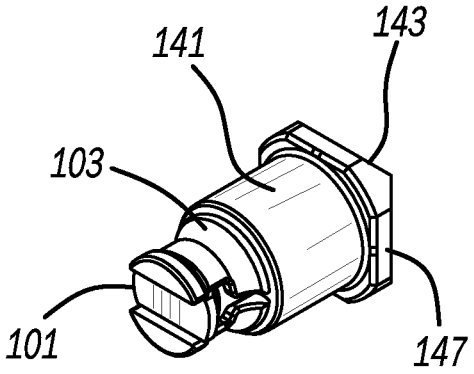
Figure 10:
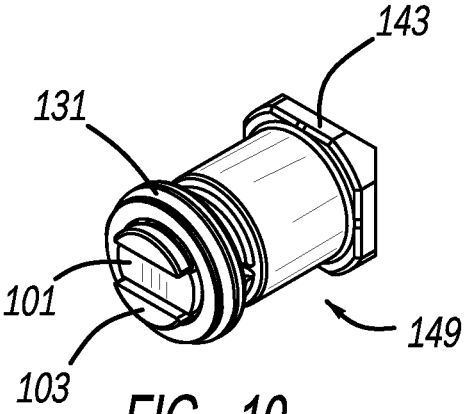
Figure 11:
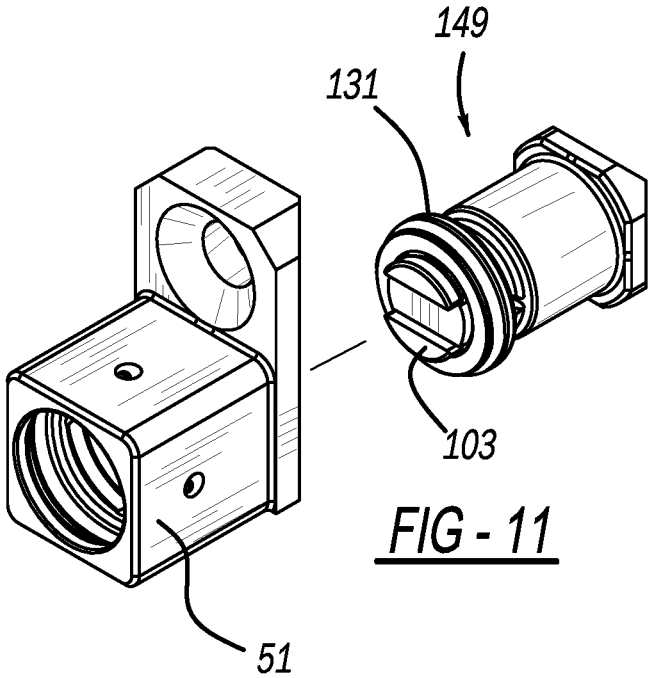
Figure 12:
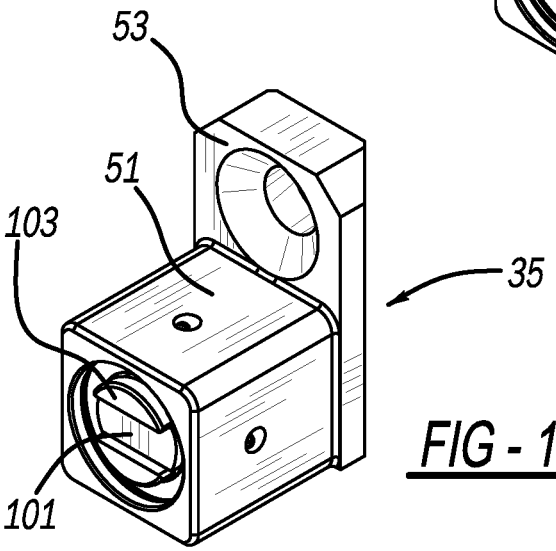

A lateral peripheral edge 147 of base 143 is polygonal and preferably square. This allows for a keying or matching shape with internal surface 69 of recess 65 of die shield 51. Therefore, the installer can first partially withdraw the die blade, anvil and ring subassembly 149 (see FIGS. 10 and 11) from the backside of the die assembly, and subsequently rotate subassembly 149 between a first orientation laterally aligned with a direction of elongation of retainer 53, as is shown in FIGS. 1 and 6, and a second orientation perpendicular thereto, as is shown in FIGS. 2-4 and 7. This keying feature beneficially provides close tolerance multi-positioning without the need to also reorient die shield 51 and retainer 53. Alternately, if peripheral edge 147 of base 143 and the matching recess 65 have six or eight flats, by way of nonlimiting examples, then even more orientations may be provided within the common die assembly component. Subassembly 149 is secured within die shield 51 in the desired orientation when screw 97 fastens retainer 53 to the underlying machine frame. This advantageously creates increased part-use flexibility, multi-functionality of components, and less inventory and specialized part requirements.

Figure 3:
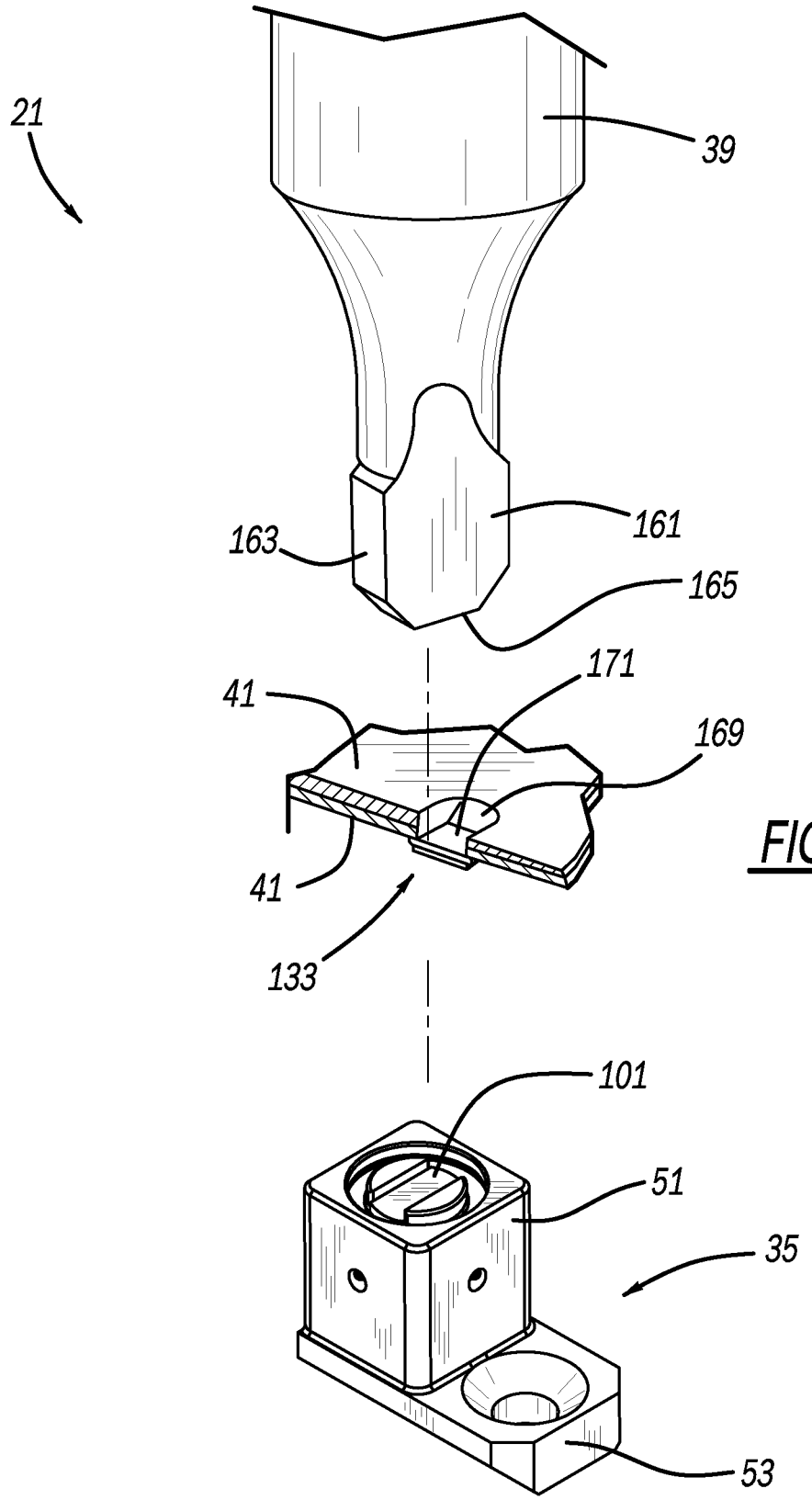
FIG. 3 is a partially exploded and top perspective view showing the first embodiment of the present fastening assembly.
Figure 4:
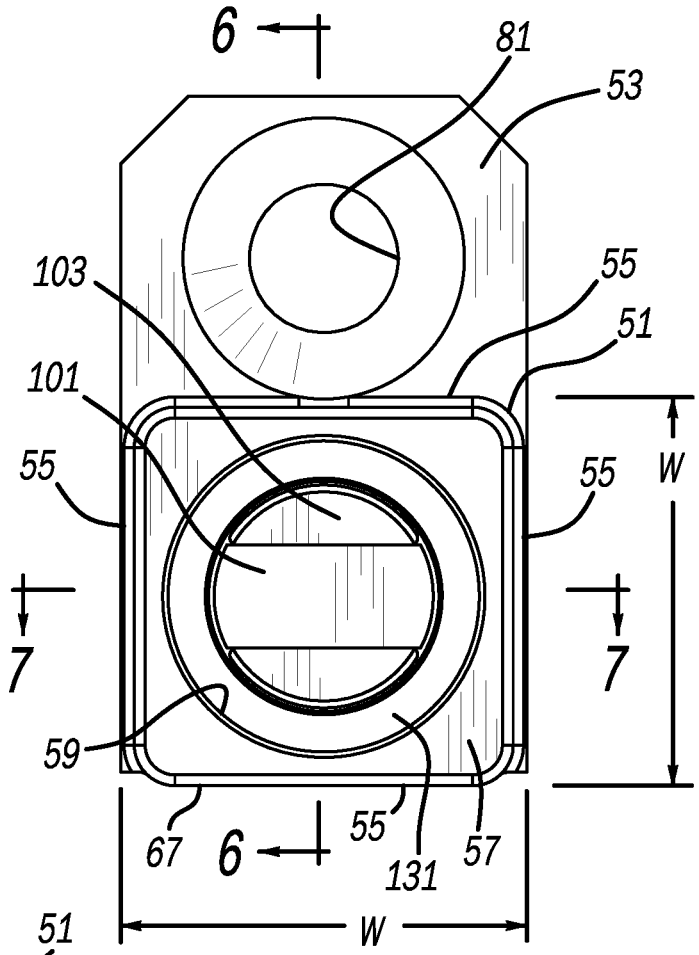
FIG. 4 is a top elevational view showing the first embodiment of the present fastening assembly.
Figure 5:
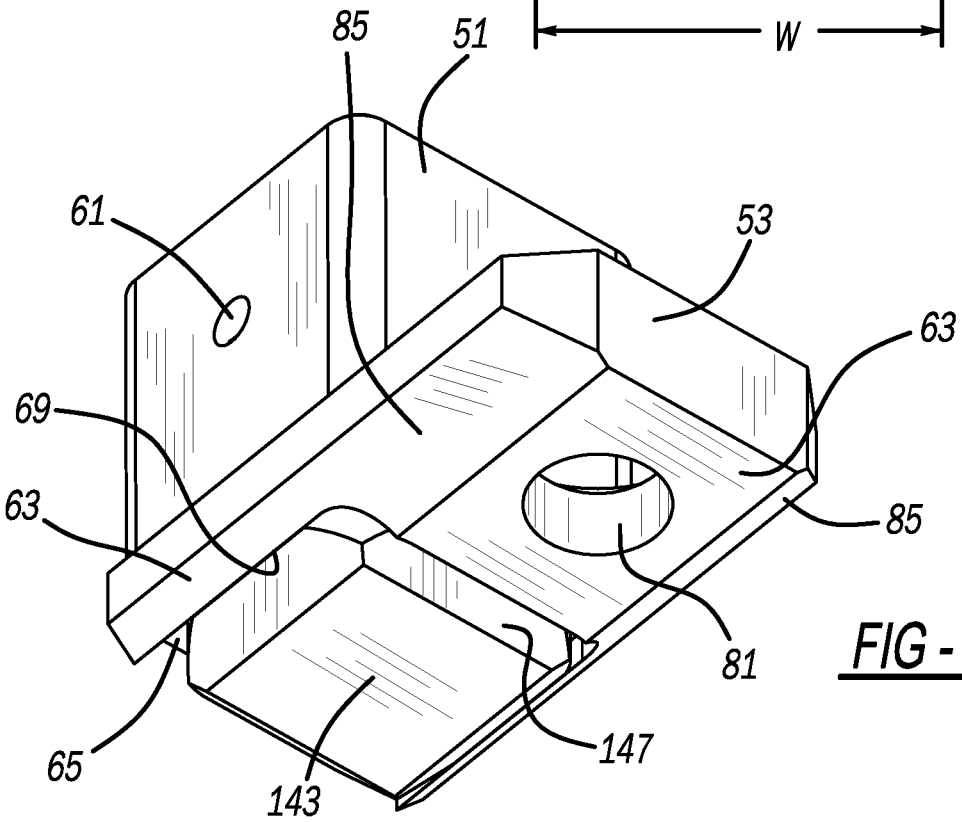
FIG. 5 is a backside perspective view showing the first embodiment of the present fastening assembly.

The specific exemplary anvil 101, die blade 103 and punch 39 illustrated in FIGS. 3 and 6 create a partially pieced and overlapping joint 133 between the sheet metal workpieces 41. Punch 39 has flat and/or slightly tapered lateral sides 161, and a thinner width edge 163 therebetween, adjacent a flat leading end 165. Tapered punch corners connect between edges 163 and end 165. The interaction of punch 39, anvil 101 and die blades 103 deform the workpieces to create joint 133 having ramps 169 extending from the nominal surfaces and a cup-like offset bottom 171 spanning between the ramps, in one lateral direction, but severs the cup in the other lateral direction bordering the joint bottom. Also, the punch compressing against the anvil laterally expands an uppermost of the bottom cup beyond the severed edges. Thus, no extra fastener is employed, in contrast to riveting, and no heating is employed, in contrast to welding. It is noteworthy that an intersection of the ramps to the nominal workpiece surfaces are preferably straight lines at the bend, however, the illustrated true view curvature may alternately be used if the punch taper is also curved.

Moreover, the specific flat sided shape of die shield 51 advantageously allows close access of the anvil to the workpieces especially when the workpieces need to be fastening on a flange near a tightly bent main surface. Referring to FIGS. 8-12, the specific rear-installed and adjustable anvil, die blade and ring subassembly 149 into die shield 51, beneficially create a low height package for die assembly 35, which is also easier to access for tight fitting workpiece designs. Nevertheless, the extra radial material present in the corners, between the circular through bore 59 and the generally square periphery 67 (see FIG. 4), provides additional thickness and hoop strength for the die shield but without interfering with close workpiece access.

Figure 14:
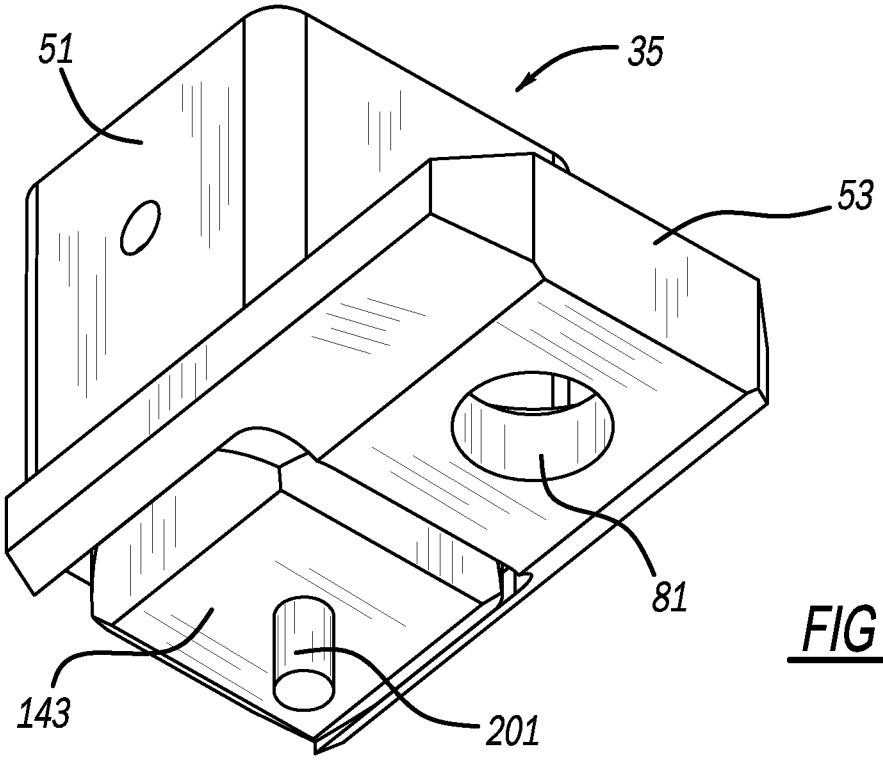
FIG. 14 is a backside perspective view showing a second embodiment of the present fastening assembly.

Reference should now be made to FIG. 14. An optional locating pin 201 longitudinally and integrally projects from the backside of base 143 coaxially aligned with a centerline through the anvil. Pin 201 is longitudinally elongated parallel to the through bore of die shield 51 and also to bore 81 of retainer 53. Furthermore, pin 201 is received within a hole drilled into a bottom of the pocket of the machine frame.

Figure 15:
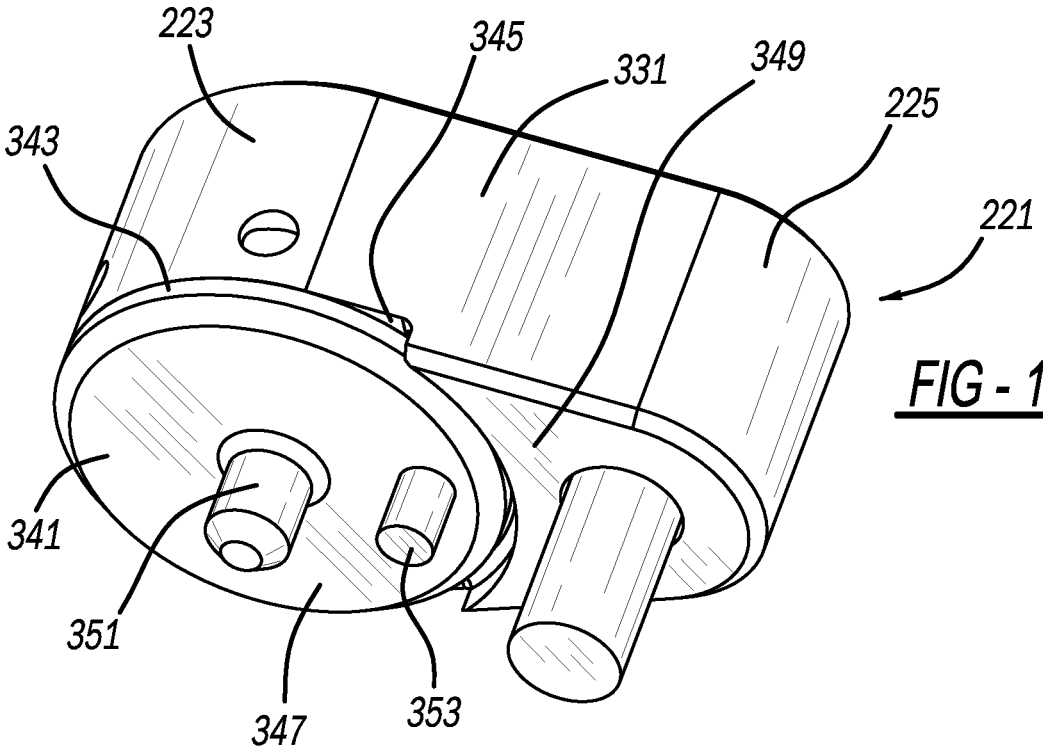
FIG. 15 is a backside perspective view showing a third embodiment of the present fastening assembly.
Figure 16:
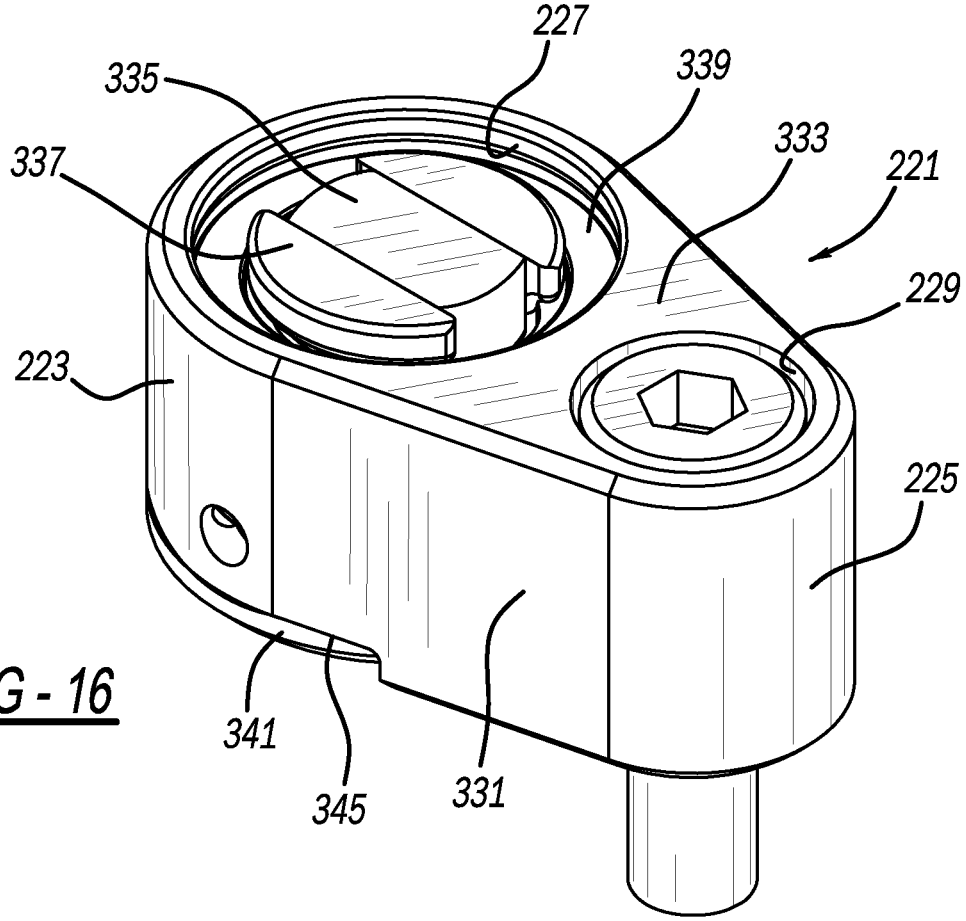
FIG. 16 is a top perspective view showing the third embodiment of the present fastening assembly.

Another embodiment of a die assembly 221 is illustrated in FIGS. 15 and 16. This exemplary embodiment includes a differently shaped die guard having integrally machined die shield 223 and retainer 225 sections with parallel through bores 227 and 229, respectively. Opposite ends of the die shield and retainer sections are laterally curved with straight lateral sides 331 spanning therebetween. A workpiece contacting end 333 is coplanar, flat and at the same height for both the die shield and retainer sections, unlike the stepped shape of the previous embodiments. An anvil 335, die blades 337 and biasing ring 339 are the same as with the first embodiment, however, a base 341 of the anvil differs. The present base 341 has a generally circular and curved peripheral edge 343 which laterally extends wider than an intermediate die body section of the anvil. The laterally outer portion of base 341 fits without a bottom recess 345 of die shield 223, such that a backside surface 347 of the base is essentially co-planar with a backside surface 349 of retainer 225 to provide a flush fit within the machine frame pocket.

Longitudinally projecting and parallel centering and orientation pins 351 and 353, respectively, downwardly extend from backside surface 347 of base 341. Centering pin 351 is coaxial with a centerline of anvil 335 while orientation pin 353 is offset spaced therefrom. Pins 351 and 353 are received within holes in the machine frame, and there may be multiple circumferentially spaced holes to optionally set orientation pin 353 in different rotational orientations, which correspondingly differently orients the anvil and die blades without the need to differently mount the die shield and retainer. This embodiment also acts with an actuator-driven punch to create an interlocking and partially severed joint between sheet metal workpieces.

Figure 17:
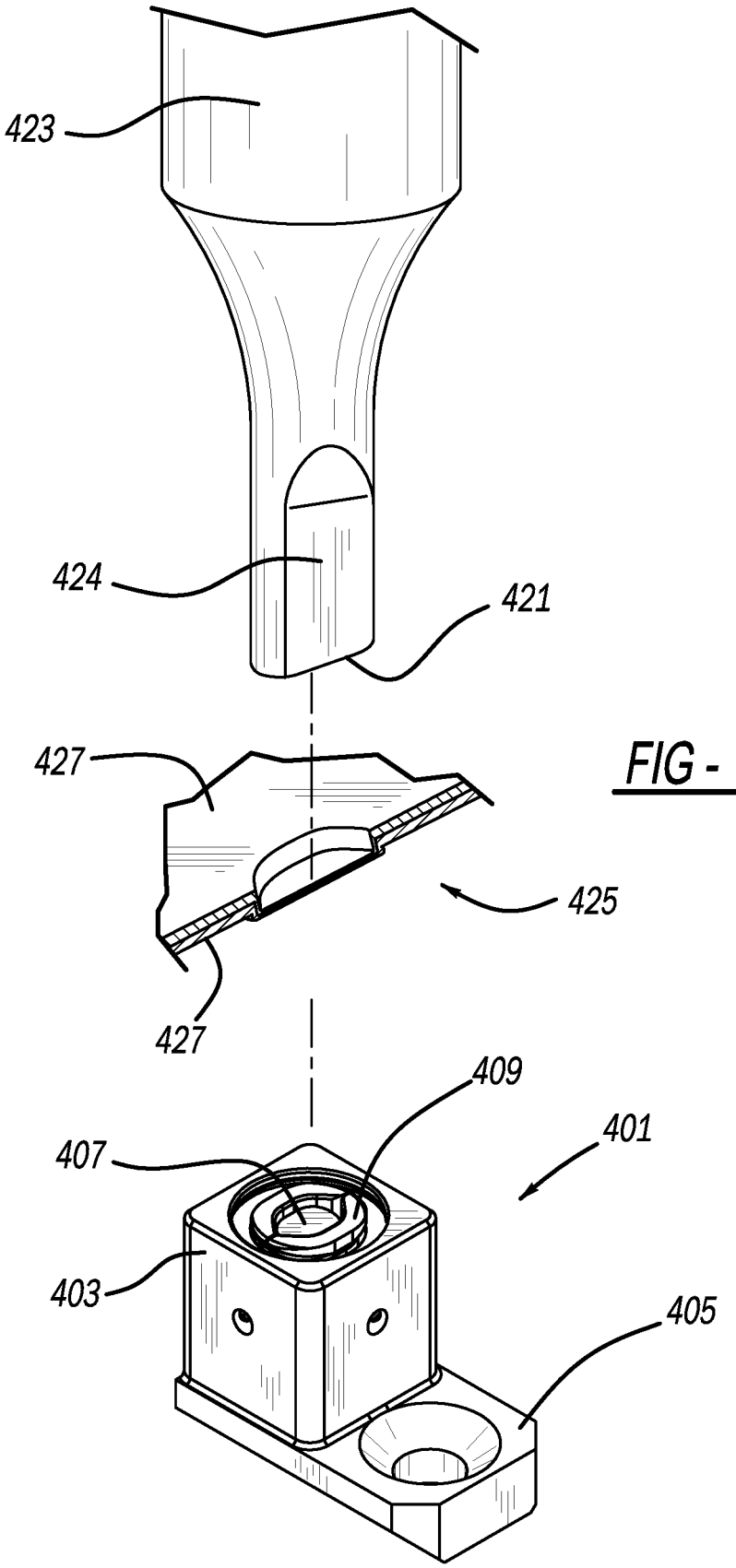
FIG. 17 is a partially exploded and top perspective view showing a fourth embodiment of the present fastening assembly.

Finally, FIG. 17 shows another embodiment die assembly 401. A die shield 403 and retainer 405 are identical to the first embodiment discussed hereinabove. However, the present anvil 407 and die blades 409 have a generally ovular end view shape thereto. Furthermore, the metal-working exposed edges extending beyond the metal-working surface of anvil 407, laterally contact each other when fully compressed against the lateral sides of the anvil by a biasing ring. A polygonal base and matching recess in a backside of the die shield are the same in this exemplary configuration as in the first embodiment Moreover, a metal-working leading end 421 of an actuator-driven punch 423 has a generally oval shape (or rounded edges bordering flat side faces 424) and is coaxially aligned with a centerline of anvil 407. In this apparatus configuration, an unpierced, clinch joint 425 interlocks together sheet metal workpieces 427 with a generally ovular expanded button located closest to the anvil and a depressed cup shape on the punch side. This shape of clinch joint is preferably leak-proof, deters workpiece-to-workpiece rotation, and does not employ a separate fastener such as a rivet.

Figure 18:
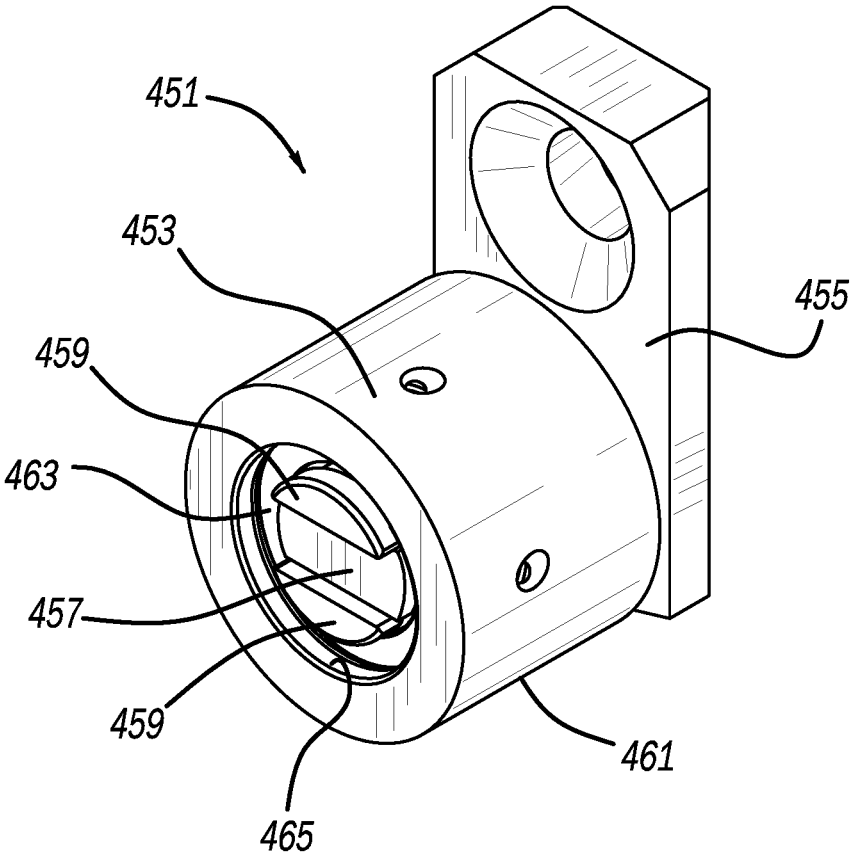
FIG. 18 is a perspective view showing a fifth embodiment of the present fastening assembly.

Reference should now be made to FIG. 18. A fifth embodiment die assembly 451 includes a die guard having a die shield section 453 and a retainer section 455 machined as a single integral part. This configuration of die shield section 453 employs a circular-cylindrical outer surface 461 longitudinally extending more than twice the height and more preferably at least four times the height of the longitudinal height dimension of the retainer. A concentric circular-cylindrical inner surface of a through bore 465 is also present. Retainer 453 laterally extends from one side of die shield section 453 but not the opposite side, and a tapered backside surface continuously laterally extends under the retainer and die shield sections adjacent an elongated edge. Moveable die blades 459 are biased toward a central anvil 457 by a flexible ring or spring 463 as with the previous embodiments. A laterally enlarged base (with either the polygonal or curved periphery, and with an optional centering and/or orientation pins) is integrally formed with anvil 457 and is optionally keyed with matching interior surfaces of the die shield and/or with spaced apart holes in the frame to which the die assembly is removably mounted.

While various embodiments have been disclosed, it should be appreciated that other variations are possible. For example, a different quantity and shape of die blades may be employed although certain benefits may not be realized. Furthermore, the ring or spring biasing component may be differently configured although some of the advantages of the present components may not be obtained. It is also envisioned that the die blades may be fixed and not movable, but certain advantages will not be observed. While it has been disclosed to mount the present die assembly into a pocket of a machine frame, it is alternately envisioned that the present die assembly can be removably attached to a flat machine, tool, fixture or robotically movable surface without a recessed pocket. Moreover, each of the components disclosed herein may have different dimensions, shapes or materials but certain benefits may not be achieved. It should also be appreciated that the terms "top," "bottom," "upper," "lower," "back," "side," "end" and other such phrases are merely relative terms which may vary if the parts are inverted or differently oriented. The method steps may be performed in any order or even simultaneously for some operations. The features of any embodiment may be interchanged with any of the other embodiments, and the claims may be multiply dependent in any combination. Therefore, other variations may fall within the scope and spirit of the present invention.

The invention claimed is:

1. A fastening apparatus comprising:

a metal-working die including a central anvil having a longitudinal centerline direction and a base enlarged in a lateral direction perpendicular thereto;

multiple die blades located adjacent to lateral surfaces of the anvil and operably moveable relative to the anvil;

an external die shield entirely laterally surrounding the anvil and the die blades;

peripheral lateral sides and a workpiece-facing end of the die shield have a substantially cubic shape with the workpiece-facing end of the die shield being substantially square;

a biasing member biasing the die blades toward the anvil, the biasing member being located internal to the die shield;

a die-to-frame retainer integrally being a single part with the die shield;

the die shield including a through bore within which is located the anvil and the die blades; and the retainer including a through bore, the through bores having parallel centerlines.

2. The apparatus of claim 1, further comprising:

multiple pins projecting from a backside of the base parallel to the centerlines of the through bores.

3. The apparatus of claim 1, further comprising:

the anvil and the die blades being removable from a backside of the die shield;

the base being laterally larger than the through bore of the die shield;

the retainer laterally extending from the die shield and having a small height than the die shield; and a fastener removeably located in a through bore of the retainer.

4. The apparatus of claim 1, wherein:

rounded corners are located on the cubic shaped die shield; and the through bore of the die shield is cylindrical.

5. The apparatus of claim 1, wherein:

workpiece contacting ends of the die blades are spaced apart from each other on opposite lateral sides of the anvil when the die blades are located against the lateral sides of the anvil; and the die blades and the anvil are configured to create a partially pierced and interlocking, sheet metal joint without the use of a separate fastener.

6. The apparatus of claim 1, wherein:

edges of the die blades contact each other when biased against lateral sides of the anvil; and the die blades and the anvil are configured to create a deformed, unpierced and interlocking, sheet metal clinch joint.

7. The apparatus of claim 1, further comprising:

a lateral edge of the base projecting outwardly past a lateral dimension of a workpiece-facing surface of the anvil;

a centering pin projecting from a backside of the base along the centerline of the anvil; and an orientation pin projecting from the backside of the base offset from the centering pin.

8. The apparatus of claim 1, further comprising:

a die shield height dimension minus a retainer height dimension, in the longitudinal centerline direction, being no taller than 15 mm;

a die shield width dimension in perpendicular lateral directions being no wider than 14 mm;

an elongated punch coaxially aligned with and being automatically movable toward the anvil between the die blades; and multiple sheet metal workpieces deforming and interlocking together when compressed between the punch and the anvil, the workpieces overlying the square workpiece-facing end of the die shield when being deformed.

9. The apparatus of claim 1, further comprising:

rounded corners located on the cubic shaped shield section;

perpendicular lateral dimensions between opposite of the flat exterior surfaces of the shield section being equal; and the inside lateral surface of the bore of the shield section being cylindrical, with a greater radial dimension between the bore of the shield and the corners than a radial dimension between the bore of the shield and the lateral flat exterior surfaces between the corners.

10. A fastening apparatus comprising:

a metal-working die including a central anvil having a longitudinal centerline direction and a base enlarged in a lateral direction perpendicular thereto;

multiple die blades located adjacent to lateral surfaces of the anvil and operably moveable relative to the anvil;

an external die shield laterally surrounding the anvil and the die blades;

peripheral lateral sides and a workpiece-facing end of the die shield have a substantially cubic shape with the workpiece-facing end of the die shield being substantially square;

a retainer laterally extending from the die shield, the die shield and the retainer having an L-shape;

apertures extending through the lateral sides of the die shield; and an exterior of the lateral sides of the die shield being flat.

11. A fastening apparatus comprising:

a metal-working die including a central anvil having a longitudinal centerline direction and a base enlarged in a lateral direction perpendicular thereto;

multiple die blades located adjacent to lateral surfaces of the anvil and operably moveable relative to the anvil;

an external die shield laterally surrounding the anvil and the die blades;

peripheral lateral sides and a workpiece-facing end of the die shield have a substantially cubic shape with the workpiece-facing end of the die shield being substantially square; and a retainer laterally extending from only a single side of the die shield, the retainer including a tapered peripheral edge and a through-bore.

12. A fastening apparatus comprising:

a metal-working die including a central anvil having a longitudinal centerline direction and a base enlarged in a lateral direction perpendicular thereto;

multiple die blades located adjacent to lateral surfaces of the anvil and operably moveable relative to the anvil;

an external die shield laterally surrounding the anvil and the die blades;

peripheral lateral sides and a workpiece-facing end of the die shield have a substantially cubic shape with the workpiece-facing end of the die shield being substantially square;

the base integrally mounted to a backside end of the anvil as a single piece;

a polygonal lateral edge of the base projecting outwardly past a lateral dimension of a workpiece-facing surface of the anvil; and the base being rotatable between various positions matching with a recess in the die shield, in order to reorient the anvil relative to the die shield.

13. A fastening apparatus comprising:

a die guard comprising a shield section and a retainer section integrally being a single part, the shield section including a bore with an arcuate internal lateral surface and the retainer section including a bore, the bores being accessible in parallel directions;

an anvil being removeably located within the bore of the shield section;

die blades positioned between the anvil and the internal surface of the shield section, and workpiece-facing ends of the die blades projecting past a workpiece-facing surface of the anvil; and peripheral lateral sides and a workpiece-facing end of the shield section having a substantially cubic shape with flat exterior surfaces.

14. The apparatus of claim 13, further comprising:

a biasing member urging the workpiece-facing ends of the die blades toward the anvil, the die blades being moveable relative to the anvil and the die shield section;

the anvil and die blades being removable from a backside of the bore of the shield section; and a threaded fastener removeably located in the bore of the retainer section, the retainer section having a height less than half of a height of the shield section.

15. The apparatus of claim 13, wherein:

the die blades are spaced apart from each other on opposite lateral sides of the anvil; and the die blades and the anvil are configured to create a partially pierced and interlocking, sheet metal joint without the use of a separate fastener.

16. The apparatus of claim 13, wherein:

edges of the die blades contact each other on lateral sides of the anvil; and the die blades and the anvil are configured to create a deformed, unpierced and interlocking, sheet metal clinch joint.

17. The apparatus of claim 13, wherein the die shield section and the retainer section have an L-shape, and one aperture extends through each of the flat exterior surfaces of the shield section such that lines spanning between opposite of the apertures intersect a longitudinal centerline of the anvil.

18. The apparatus of claim 13, further comprising a tapered edge located on the retainer section and continuing adjacent a backside of the shield section.

19. The apparatus of claim 13, wherein:

the anvil includes a base integrally mounted thereto as a single piece; and a polygonal lateral edge of the base is rotatable between various positions keying with a recess of the shield section, in order to reorient the anvil relative to the shield section.

20. The apparatus of claim 13, further comprising:

a centering pin projecting from a backside of an enlarged base along a centerline of the anvil, the base being affixed to the anvil; and an orientation pin projecting from the backside of the base offset from the centering pin.

21. The apparatus of claim 13, further comprising:

a shield section height dimension minus a retainer section height dimension being no taller than 15 mm;

a shield section width dimension being no wider than 14 mm;

an elongated punch coaxially aligned with and movable toward the anvil between the die blades;

multiple sheet metal workpieces deforming and interlocking together when compressed between the punch and the anvil; and the workpieces overlying the workpiece-facing end of the die shield section, which is square shaped with rounded corners, when being deformed.

22. A fastening apparatus comprising:

a die including an anvil with a working end surface;

a die projection located adjacent to lateral surfaces of the anvil, the die projection having a workpiece-contacting end longitudinally extending past the working end surface of the anvil;

a die housing laterally surrounding the anvil;

a workpiece-facing end of the die housing including a square true view shape with rounded or chamfered corners;

an extension laterally extending from a single side of the die housing, the extension including a fastener-receiving bore;

lateral width dimensions of the die housing being equilateral;

a longitudinally elongated punch coaxially aligned with and movable toward the anvil; and flanges of multiple workpiece sheets interlocking together when compressed between the punch and the anvil, the workpiece sheets overlying the workpiece-facing end of the die housing, when being deformed.

23. The apparatus of claim 22, further comprising:

an enlarged base integrally mounted to the anvil as a single piece;

a polygonal lateral edge of the base being rotatable between various positions keying with a receptacle of the die housing, in order to reorient the anvil and die blades relative to the die housing;

the die blades being moveable between the anvil and a cylindrical internal surface of the die housing; and a biasing member surrounding the die blades and biasing them toward the anvil.

24. The apparatus of claim 22, further comprising:

an enlarged base laterally projecting from a backside of the anvil;

a centering pin projecting from a backside of the base along a centerline of the anvil; and an orientation pin projecting from the backside of the base offset from the centering pin.

25. The apparatus of claim 22, wherein:

the die housing includes a through bore which is cylindrical, with a greater radial dimension between the bore and the corners than a radial dimension between the bore and lateral flat exterior surfaces of the die housing between the corners; and the extension includes a fastener-receiving through bore oriented parallel to the through bore of the die housing.

26. A fastening apparatus comprising:

a die shield;

a die retainer coupled to and laterally projecting from the die shield;

an anvil being removeably located within a through-bore of the die shield;

die blades located between the anvil and an internal surface of the die shield, and workpiece-facing ends of the die blades projecting past a workpiece-facing surface of the anvil;

an enlarged base coupled to the anvil laterally extending outwardly from a backside of the anvil;

a centering pin projecting from a backside of the base along a centerline of the anvil;

an orientation pin projecting from the backside of the base offset from the centering pin; and the anvil, base and die blades being removable from a backside of the die shield, the anvil and the base being rotatable between different orientations relative to the die shield and the die retainer.

27. The apparatus of claim 26, further comprising:

a biasing member urging a workpiece-engaging end of the die blades toward the anvil;

the die shield including opposite flat exterior side surfaces;

the anvil and die blades being removeably located within the through-bore of the die shield such that the die blades are movably positioned between the anvil and an internal cylindrical surface of the die shield, with the biasing member located between the die blades and the die shield; and a fastener removeably located in a through-bore of the retainer section.

28. The apparatus of claim 26, further comprising:

a retainer laterally projecting from the die shield, the retainer including a fastener-receiving through bore and a workpiece facing surface offset stepped less than half of a height of the die shield;

the base being received within a recess of the die shield and a backside surface of the base being adapted to contact a machine surface to which the die shield and the retainer are removeably mounted;

the die blades being spaced apart from each other on opposite lateral sides of the anvil; and the die blades and the anvil being configured to create a pierced and interlocking, sheet metal joint without the use of a separate fastener.

29. The apparatus of claim 26, further comprising:

a retainer laterally projecting from the die shield, the retainer including a fastener-receiving through bore and a workpiece facing surface offset stepped less than half of a height of the die shield;

the base being received within a recess of the die shield and a backside surface of the base being adapted to contact a machine surface to which the die shield and the retainer are removeably mounted;

edges of the die blades contacting each other on lateral sides of the anvil; and the die blades and the anvil being configured to create a deformed, unpierced and interlocking, sheet metal clinch joint.

30. The apparatus of claim 26, further comprising:

a retainer laterally extending from the die shield, the die shield and the retainer having an L-shape, and apertures extending through lateral and flat exterior faces of the die shield; and the base including a polygonal shaped peripheral edge which is keyed to match adjacent surfaces of at least one of the die shield and the die retainer.

31. A fastening apparatus comprising:

a die shield;

a die retainer integrally and laterally projecting from one side of the die shield but not the opposite side, as a single piece;

an anvil removeably located within a through-bore of the die shield;

die blades located between the anvil and an internal surface of the die shield, and workpiece-facing ends of the die blades projecting past a workpiece-facing surface of the anvil;

an enlarged base coupled to the anvil laterally extending outwardly from a backside of the anvil;

the die retainer including a fastener-receiving through bore and a workpiece facing surface offset stepped less than half of a longitudinal height of the die shield; and the anvil, base and die blades being removable from a backside of the die shield;

and the anvil and the base being rotatable between different orientations relative to the die shield and the die retainer.

32. The apparatus of claim 31, further comprising:

a biasing member urging the workpiece-engaging ends of the die blades toward the anvil;

the die shield including opposite flat exterior side surfaces;

the through bores of the die shield and the die retainer having parallel longitudinally elongated centerlines and being accessible in the same longitudinal direction; and the through bore of the die shield being cylindrical.

33. The apparatus of claim 31, further comprising:

a biasing member urging the workpiece-engaging ends of the die blades toward the anvil;

the die shield including a cylindrical exterior side surface surrounding the anvil and being longitudinally elongated; and the through bores of the die shield and the die retainer having parallel longitudinally elongated centerlines and being accessible in the same longitudinal direction.

34. The apparatus of claim 31, wherein:

the base is received within a recess of the die shield, and a backside surface of the base is adapted to contact a machine surface to which the die shield and the die retainer are removeably mounted; and the die blades and the anvil are configured to create a pierced and interlocking, sheet metal joint without the use of a separate fastener.

35. The apparatus of claim 31, wherein:

the base is received within a recess of the die shield, and a backside surface of the base is adapted to contact a machine surface to which the die shield and the die retainer are removeably mounted; and the die blades and the anvil are configured to create a deformed, unpierced and interlocking, sheet metal clinch joint.

* * * * *